US006210124B1

(12) United States Patent
Fagerli et al.

(10) Patent No.: US 6,210,124 B1
(45) Date of Patent: Apr. 3, 2001

(54) VARIABLE SWASH PLATE COMPRESSOR

(75) Inventors: Bjoern Fagerli, Urbaba, IL (US); Lavlesh Sud; Shane A. Harte, both of Farmington Hills, MI (US); Vipen Khetarpal, Novi, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/492,431

(22) Filed: Jan. 27, 2000

(51) Int. Cl.[7] ..... F04B 1/28
(52) U.S. Cl. ..... 417/222.1
(58) Field of Search ..... 417/222.1, 222.2, 417/269, 270

(56) References Cited

U.S. PATENT DOCUMENTS

| | | |
|---|---|---|
| Re. 35,878 | 8/1998 | Kimura . |
| 4,425,837 | 1/1984 | Livesay . |
| 4,884,952 | 12/1989 | Kanamaru . |
| 4,934,253 | 6/1990 | Berthold . |
| 4,963,074 | 10/1990 | Sanuki . |
| 5,022,826 | 6/1991 | Matsuda . |
| 5,259,736 | 11/1993 | Terauchi . |
| 5,370,503 | 12/1994 | Terauchi . |
| 5,560,277 | 10/1996 | Nomura . |

*Primary Examiner*—Teresa Walberg
*Assistant Examiner*—Vinod D. Patel
(74) *Attorney, Agent, or Firm*—Ray Coppiellie

(57) ABSTRACT

A variable swash plate compressor (10), including a housing (12), a top inlet (14A), a bottom inlet (14B) , a pumping chamber (16), a compression piston (18), a top outlet (20A), a bottom outlet (20B) , a drive shaft (22) , a control surface element (24), a pinnacle element (26), a swash plate (28), a bore (30) and a pocket (32) formed in the swash plate (28), a pivot element tip (38) and fulcrum piston assembly (40). Wherein the angle of the swash plate (28) relative to the drive shaft (22) is varied to bring about a larger or smaller travel path of the compression piston (18) and thereby increasing or decreasing the output capacity of the variable swash plate compressor (10).

29 Claims, 2 Drawing Sheets

VARIABLE SWASH PLATE COMPRESSOR

TECHNICAL FIELD

The present invention relates generally to a swash plate compressor and more particularly to improvements to such a compressor so that the size, energy consumption, and vibrational characteristics are minimized.

BACKGROUND ART

Conventional swash plate compressors utilize a rotating swash plate, driven by a drive shaft, to drive a piston. The piston is used to transfer fluid from the low pressure side of an air conditioning system or other device to the high pressure side. Conventional swash plate compressors utilize an elbow to transfer the rotational drive of the drive shaft to the swash plate. The utilization of an elbow, or similar mechanism, to transfer the rotational drive of the drive shaft has several undesirable characteristics. This conventional design transfers undesirable stresses to the swash plate requiring the swash plate to be designed for a higher strength. This adds to the size, weight, and cost of the swash plate compressor. The presence alone of the elbow or similar mechanism adds to the size, weight, complexity and manufacturing cost of the conventional swash plate compressor. In addition, the elbow, as it rotates with the drive shaft, limits the potential travel distance of the piston.

It is known that varying the angle of the swash plate relative to the drive shaft allows the swash plate compressor to produce variable fluid transfer rates. One known design utilizes a biasing spring and the crankcase pressure within the compressor to vary the angle of the swash plate. This crankcase pressure can lead to undesirable stresses on the swash plate and can have a negative effect on the vibrational characteristics of the swash plate compressor.

Finally, the piston driving mechanisms in known variable swash plate compressors utilize multiple pivot locations. The swash plate itself typically slides and/or rotates axially on the drive shaft, the elbow joint slides and/or rotates about a pin in the elbow, and the piston joint rotates about its connection with the swash plate. The position and rotation of the swash plate, the elbow, and the piston in relation to each pivot location controls the path of the piston. These multiple pivot locations often result in a variable Top-Dead-Center ("TDC") of the piston. The TDC of the piston is the distance between the piston face and the piston chamber outlet face at the top of the piston cycle. Variations in the piston TDC result in undesirable variations in the variable swash plate compressor's output.

Therefore, there is a need for a variable swash plate compressor design that reduces the stresses in the swash plate, allows for greater piston travel without increasing the compressor size, reduces undesirable vibrational characteristics, reduces variation in piston TDC, and reduces the size, weight, and manufacturing cost of known variable swash plate compressor designs.

SUMMARY OF THE INVENTION

It is therefore an object of the present invention to provide a variable swash plate compressor that reduces the stress in the swash plate, reduces vibrations in the compressor, and reduces the variation in piston TDC. It is a further object of the present invention to provide a variable swash plate compressor that reduces the size, weight, and manufacturing costs associated with conventional swash plate compressor design.

In accordance with the objects of this invention, a variable swash plate compressor is provided. The variable swash plate compressor includes a housing, a drive shaft and a control surface element. The control surface element is attached to and receives a rotational drive force from the drive shaft. The control surface element has a pinnacle element attached thereto.

The variable swash plate compressor also includes a swash plate with a bore located in its center. The control surface element sits within the bore of the swash plate. The swash plate also includes a pocket in which the pinnacle element is seated. The drive shaft transmits a rotational drive force to the swash plate through the control surface element seated in the bore of the swash plate and the pinnacle element seated in the swash plate pocket.

The variable swash plate compressor also includes a compression piston positioned within a piston chamber formed in the housing. As the compression piston moves within the piston chamber it alternates between drawing fluid into the piston chamber through an inlet and forcing fluid within the piston chamber out of an outlet. The compression piston is moved in this cyclical fashion by remaining in contact with the rotating swash plate such that only axial forces are transmitted between the swash plate and the compression piston. As the angle between the swash plate and the drive shaft is increased, the travel path of the compression piston is increased resulting in an increase in the output of the variable swash plate compressor.

The variable swash plate compressor also includes a fulcrum piston assemby for controlling the angle of the swash plate relative to the drive shaft. As the angle of the swash plate relative to the drive shaft is increased, the output of the variable swash plate compressor is increased. The fulcrum piston assembly changes the angle of the swash plate by exerting a force on the swash plate causing it to pivot about the tip of the pinnacle element. The tip of the pinnacle element orbits the axial center of the drive shaft at a distance equal to the distance from the center of the drive shaft to the axial center of the compression piston. By pivoting the swash plate about a point that orbits over the axial center of the compression piston, variation in the TDC of the compression piston is reduced.

Other objects and features of the present invention will become apparent when viewed in light of the detailed description of the preferred embodiment when taken in conjunction with the attached drawings and appended claims.

DESCRIPTION OF THE PREFERRED EMBODIMENT(S)

Figure 1:
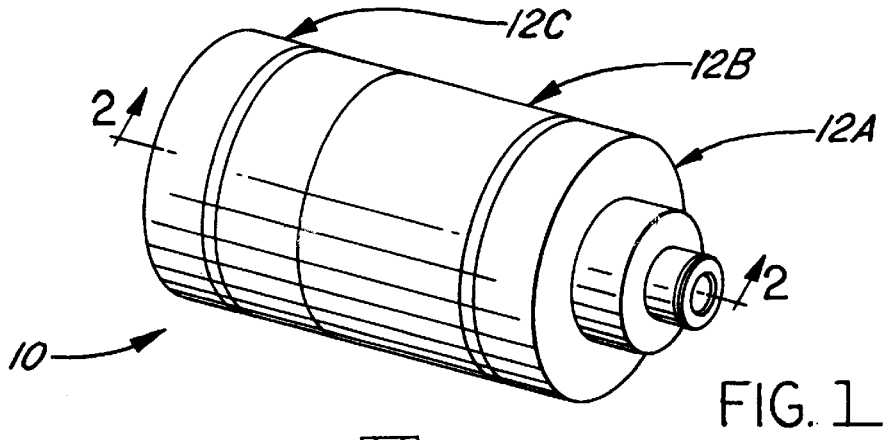
FIG. 1 is a perspective view of a preferred embodiment of a variable swash plate compressor in accordance with the present invention.

Referring now to FIG. 1, which is a schematic view of a variable swash plate compressor 10 in accordance with the present invention. The disclosed variable swash plate compressor 10 is preferably for use in automotive air conditioning applications. However, the disclosed variable swash plate compressor 10 may be used in a variety of applications, including non-automotive applications.

Figure 2:
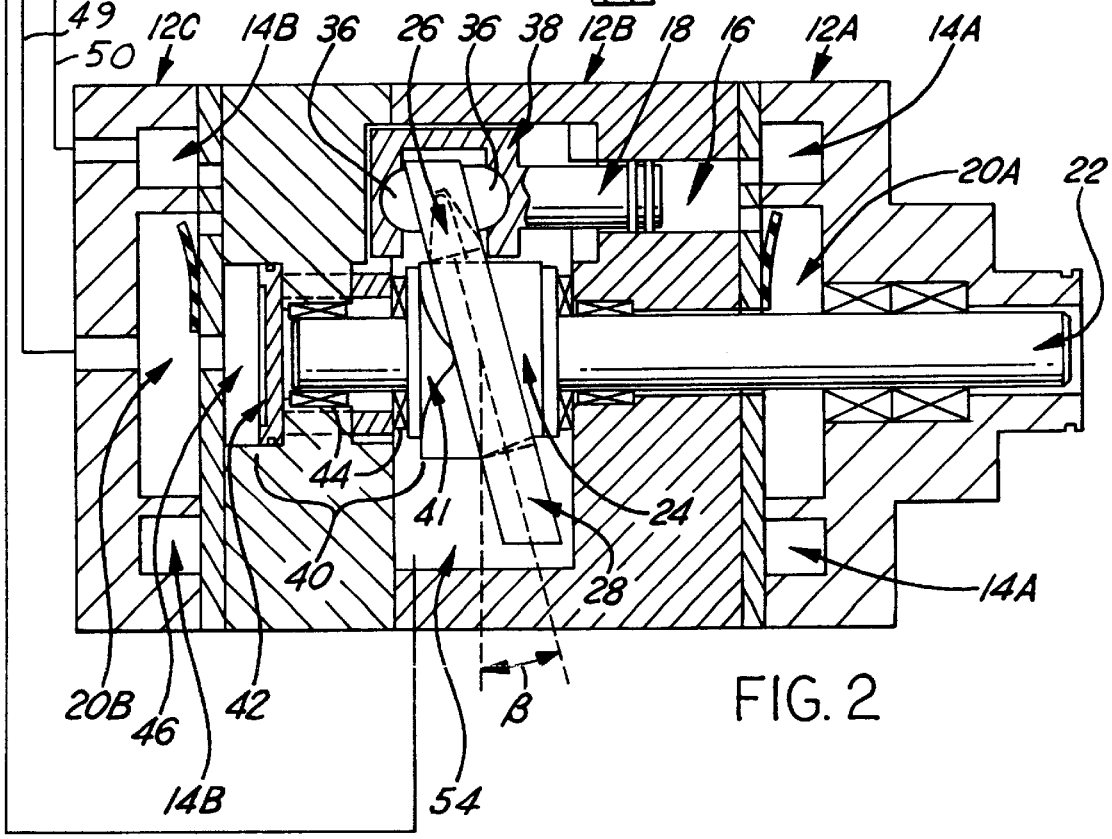
FIG. 2 is a cross-sectional view of the variable swash plate compressor illustrated in FIG. 1, the cross-section being taken along the line 2—2 in FIG. 1 and in the direction of the arrows, the cross-section illustrating the variable swash plate compressor in its nonidle position.

Referring now to FIG. 2, which is a cross-sectional view of the variable swash plate compressor 10 in accordance with the present invention. The variable swash plate compressor 10 includes a housing 12. In the embodiment shown in FIG. 2, the housing 12 is comprised of a top housing section 12A, a middle housing section 12B, and a bottom housing section 12C. A top inlet 14A is located within the top housing 12A and is in fluid connection with a bottom inlet 14B located within the bottom housing 12C to allows fluid to be conveyed into a pumping chamber 16 located within the middle housing 12B. The bottom inlet 14B is in fluid communication with a source of fluid outside the compressor 10. A compression piston 18 situated within the pumping chamber 16 draws fluid from the top inlet 14A into the pumping chamber 16 and is used to force the fluid within the pumping chamber 16 out through a top outlet 20A. The top outlet 20A is in fluid connection with a bottom outlet 20B to allow fluid from the top outlet 20A and the bottom outlet 20B to exit the bottom housing section 12C of the compressor 10. Although the embodiment is described in terms of inlets and outlets located on both the top and bottom of the compressor, it should be understood that in other embodiments the inlets and outlets may be located on only the top or the bottom of the compressor.

Figure 3A:
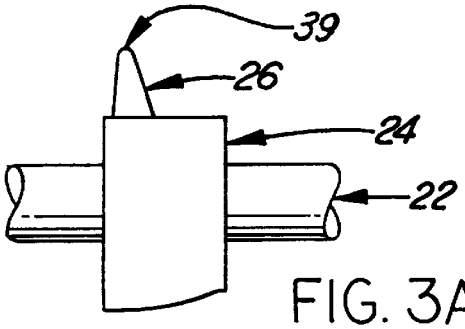
FIG. 3A is a side view of the drive shaft illustrated in FIG. 2.
Figure 3B:
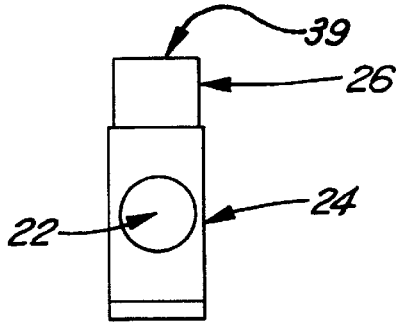
FIG. 3B is a top view of the drive shaft illustrated in FIG. 2.

The compression piston 18 is activated through the use of a drive shaft 22 located with the housing 12. In one preferred embodiment, the drive shaft 22 is imparted with a rotational drive force from a source outside the variable swash plate compressor 10. Alternatively, the drive shaft 22 may be imparted with a rotational drive force from a source within the variable swash plate compressor 10. A control surface element 24 is affixed to the drive shaft 22 and rotates in unison with the drive shaft 22. A pivot element 26 is affixed to the control surface element 24 and travels in a path radially around the axis of the drive shaft 22. FIGS. 3A and 3B illustrate the assembly of the drive shaft 22, the control surface 24 and the pivot element 26. Alternatively, the drive shaft 22, the control surface element 24, and the pivot element 26 may all be formed as a single element.

Figure 4A:
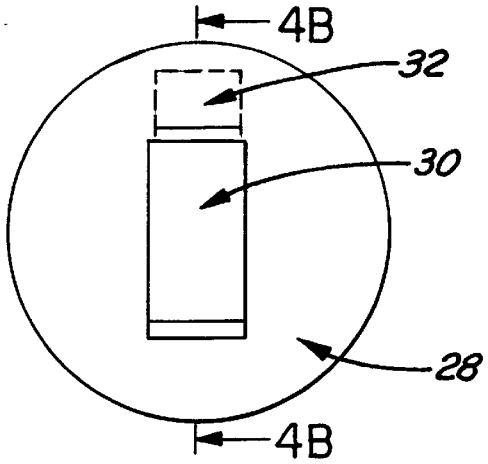
FIG. 4A is a top view of the swash plate illustrated in FIG. 2.
Figure 4B:
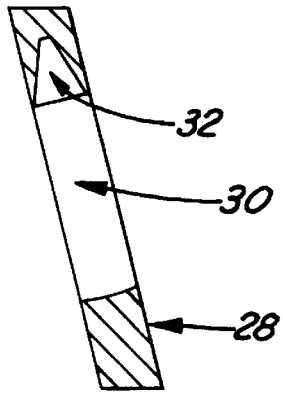
FIG. 4B is a cross-sectional view of the swash plate illustrated in FIG. 4A, the cross-section being taken along the line 4B—4B in FIG. 4A and in the direction of the arrows.

As the drive shaft 22 rotates, it imparts a drive force through the control surface 24 and the pivot element 26 to a swash plate 28. The swash plate 28 is formed with a bore 30 in which the control surface element 24 sits. The swash plate 28 is additionally formed with a pocket 32 in which the pivot element 26 sits. FIGS. 4A and 4B illustrate the swash plate 28, the bore 30 and the pocket 32. Through the bore 30 and the pocket 32, the rotational drive of the drive shaft 22 is imparted to the swash plate 28. The pocket 32 is preferably formed in the center plane of the swash plate 28 such that the drive imparted to the swash plate 28 is primarily rotational and such that stresses within the swash plate 28 are minimized.

Figure 5:
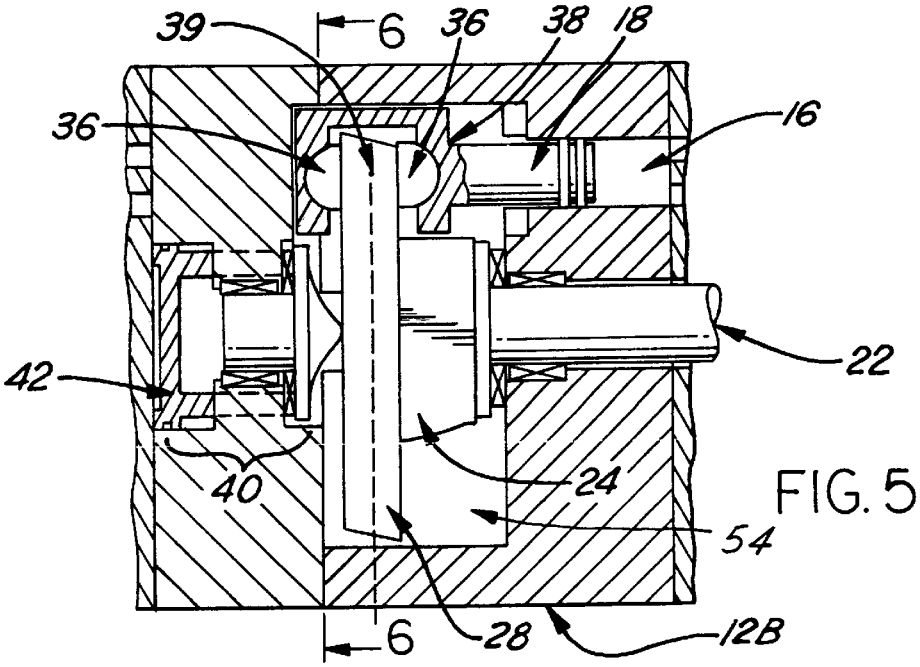
FIG. 5 is a cross-sectional view of the variable swash plate compressor illustrated in FIG. 1, the cross-section being taken along the line 2—2 in FIG. 1 and in the direction of the arrows, the cross-section illustrating the variable swash plate compressor in its idle position.

The swash plate 28 is connected to the compression piston 18 through the use of a ball joint 36 located within a generally c-shaped opening 38 in the compression piston 18. The ball joint 36 prevents the majority of the rotational drive force of the swash plate 28 from being transmitted to the compression piston 18. When the swash plate 28 is positioned at an angle β from a position perpendicular to the drive shaft 22, it moves the compression piston 18 axially within the pumping chamber 16 as the swash plate 28 rotates with the drive shaft 22. As the angle β is increased the travel path of the compression piston 18 is increased and the pumping capacity of the variable swash plate compressor 10 is increased. As the angle β approaches zero and the swash plate 28 becomes approximately perpendicular to the drive shaft 22, the output of the variable swash plate compressor 10 is minimized (see FIG. 5).

Figure 6:
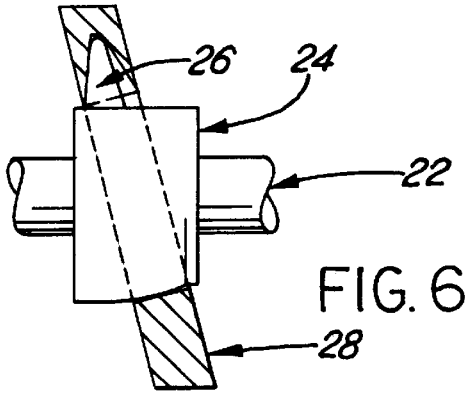
FIG. 6 is an illustration of the drive shaft, swash plate, control surface element and pinnacle element illustrated in FIG. 2.

The angle β of the swash plate 28 is increased by pivoting the swash plate 28 about the pivot element 26 (see FIG. 6). The pocket 32 located within the swash plate 28 and the pivot element 26 are shaped such that the swash plate 28 pivots about the pivot element tip 39. The pivot element tip 39 is positioned at a distance from the axial center of the drive shaft 22 approximately equal to the distance from the axial center of the compression piston 18 to the axial center of the drive shaft 22. The allows variations in the top-dead-center ("TDC") of the compression piston 18 to be minimized at all angles β of the swash plate 28. Minimization of TDC variations allows for greater control of the variable swash plate compressor 10 output.

The angle β of the swash plate 28 is varied through the use of a fulcrum piston assembly 40. The fulcrum piston assembly is comprised of a fulcrum element 41 and a control piston 42. The fulcrum element 41 is connected to the control piston 42 through the use of thrust bearings 44 to allow the fulcrum element 41 to rotate with the drive shaft 22. Fluid pressure in the output chamber 46 controls the position of the fulcrum piston assembly 40 and subsequently the angle β. The output chamber 46 remains in fluid communication with the bottom outlet 20B. A control valve 48, through a connection 49 with the output chamber 46, increases the pressure in the output chamber 46 during periods where increased compressor capacity is required. During periods where it is desirable for the compressor to remain idle, the control valve 48 allows the fluid pressure in the output chamber 46 to drop and the fulcrum piston assembly 40 drops allowing the swash plate 28 to position itself nearly perpendicular to the drive shaft 22. The advantage of using this pressure controlled system for adjusting the angle β of the swash plate 28, as opposed to using known spring biased or crackcase pressure designs, is that the fulcrum piston assembly 40 acts as a damper to minimize vibrations in the rotating swash plate 28. In another embodiment, the control valve 48 may also be used to allow a bleed line, with a bleed input 50 and a bleed output 52, to allow portions of fluid from either the top inlet 14A or the bottom inlet 14B to be in fluid communication with the crankcase 54. This allows moving parts within the crankcase 54 to be cooled and lubricated.

Although the present embodiment was described with a single compression piston 18, multiple compression pistons may be used in the variable swash plate compressor 10. One embodiment makes use of five compression pistons.

While particular embodiments of the invention have been shown and described, numerous variations and alternate embodiments will occur to those skilled in the art. Accordingly, it is intended that the invention be limited only in terms of the appended claims.

What is claimed is:

1. A compressor comprising:

a housing;

a drive shaft;

a control surface element attached to said drive shaft, wherein said drive shaft transmits a rotational drive force to said control surface element;

a pinnacle element attached to said control surface element;

a swash plate, wherein as the angle of said swash plate relative to a position perpendicular to said drive shaft increases, the output of the compressor is increased;

a bore formed in said swash plate, wherein said control surface element sits within said bore;

a pocket formed in said swash plate, wherein said pinnacle element sits within said pocket;

a fulcrum piston assembly to control the angle of said swash plate, wherein said swash plate pivots about the tip of said pinnacle element;

at least one compression piston in contact with said swash plate wherein said swash plate transmits primarily axial loads to said at least one compression piston;

at least one piston chamber formed within said housing and containing said at least one compression piston;

at least one top inlet providing fluid to said at least one piston chamber;

at least one bottom inlet in fluid communication with said at least one top inlet and in communication with a fluid source outside of the compressor;

at least one top outlet permitting fluid to exit the top of said at least one piston chamber;

at least one bottom outlet in fluid communication with said at least one top outlet;

wherein said pinnacle element has a tip that orbits the axial center of said drive shaft at a distance equal to the distance from the axial center of said drive shaft to the axial center of said at least one compression piston.

2. A compressor as described in claim 1, wherein said control surface element transmits said rotational drive force to said swash plate such that said swash plate rotates with said drive shaft.

3. A compressor as described in claim 1, wherein said pinnacle element transmits said rotational drive force to said swash plate such that said swash plate rotates with said drive shaft.

4. A compressor as described in claim 1, further comprising:

a fluid pressure chamber in fluid communication with said at least one bottom outlet, wherein the pressure of fluid in said fluid pressure chamber is varied to adjust the compressor output; and a control valve used to control pressure in said pressure chamber, wherein the pressure of fluid within said fluid pressure chamber is increased to increase the compressor output;

wherein the pressure of the fluid in said fluid pressure chamber is used to control said fulcrum piston assembly.

5. A compressor as described in claim 4, wherein said fulcrum piston assembly comprises:

a control piston in connection with fluid in said fluid pressure chamber;

a fulcrum element rotatably attached to said control piston, wherein said fulcrum element rotates with said drive shaft;

wherein as pressure is increased in said fluid pressure chamber, said fulcrum piston assembly is moved towards said swash plate thereby increasing the angle of said swash plate relative to the drive shaft.

6. A compressor as described in claim 4, wherein said control valve further comprises:

a bleed line wherein a portion of fluid from said at least one bottom inlet is in fluid connection with a crankcase.

7. A compressor as described in claim 1, wherein said pocket is formed along the center plane of said swash plate.

8. A compressor as described in claim 1, wherein said drive shaft, said control surface element and said pinnacle element are formed as a single element.

9. A compressor as described in claim 1, wherein said control surface element and said pinnacle element are formed as a single element.

10. A compressor as described in claim 1, further comprising:

a generally c-shaped opening located within said at least one compressor piston; and a ball joint positioned within said generally c-shaped opening wherein said ball joint remains in slidable contact with said swash plate;

wherein the primary forces transferred from said swash plate to said at least one compression piston are primarily limited to forces in the axial direction of said at least one compression piston.

11. A compressor as described in claim 1, wherein said control surface element is shaped such that the every side of said bore remains in contact with said control surface element at all angles of said swash plate relative to a position perpendicular to said drive shaft.

12. A compressor comprising:

a housing;

a drive shaft;

a control surface element attached to said drive shaft, wherein said drive shaft transmits a rotational drive force to said control surface element;

a pinnacle element attached to said control surface element;

a swash plate, wherein as the angle of said swash plate relative to a position perpendicular to said drive shaft increases, the output of the compressor is increased;

a bore formed in said swash plate, wherein said control surface element sits within said bore;

a pocket formed in said swash plate, wherein said pinnacle element sits within said pocket;

a fulcrum piston assembly to control the angle of said swash plate, wherein said swash plate pivots about the tip of said pinnacle element;

at least one compression piston in contact with said swash plate wherein said swash plate transmits primarily axial loads to said at least one compression piston;

at least one piston chamber formed within said housing and containing said at least one compression piston;

at least one inlet providing fluid to said at least one piston chamber and in fluid communication with a fluid source outside the compressor;

at least one outlet permitting fluid to exit the top of said at least one piston chamber;

wherein said pinnacle element has a tip that orbits the axial center of said drive shaft at a distance equal to the distance from the axial center of said drive shaft to the axial center of said at least one compression piston.

13. A compressor as described in claim 12, wherein said control surface element transmits said rotational drive force to said swash plate such that said swash plate rotates with said drive shaft.

14. A compressor as described in claim 12, wherein said pinnacle element transmits said rotational drive force to said swash plate such that said swash plate rotates with said drive shaft.

15. A compressor as described in claim 12, further comprising:

a fluid pressure chamber in fluid communication with said at least one outlet, wherein the pressure of fluid in said fluid pressure chamber is varied to adjust the compressor output; and a control valve used to control pressure in said pressure chamber, wherein the pressure of fluid within said fluid pressure chamber is increased to increase the compressor output;

wherein the pressure of the fluid in said fluid pressure chamber is used to control said fulcrum piston assembly.

16. A compressor as described in claim 15, wherein said fulcrum piston assembly comprises:

a control piston in connection with fluid in said fluid pressure chamber;

a fulcrum element rotatably attached to said control piston, wherein said fulcrum element rotates with said drive shaft;

wherein as pressure is increased in said fluid pressure chamber, said fulcrum piston assembly is moved towards said swash plate thereby increasing the angle of said swash plate relative to the drive shaft.

17. A compressor as described in claim 15, wherein said control valve further comprises:

a bleed line wherein a portion of fluid from said at least one bottom inlet is in fluid connection with a crankcase.

18. A compressor as described in claim 12, wherein said pocket is formed along the center plane of said swash plate.

19. A compressor as described in claim 12, wherein said drive shaft, said control surface element and said pinnacle element are formed as a single element.

20. A compressor as described in claim 12, wherein said control surface element and said pinnacle element are formed as a single element.

21. A compressor as described in claim 12, further comprising:

a generally c-shaped opening located within said at least compressor piston; and a ball joint positioned within said generally c-shaped opening wherein said ball joint remains in slidable contact with said swash plate;

wherein the primary forces transferred from said swash plate to said at least one compression piston are limited to forces in the axial direction of said at least one compression piston.

22. A compressor as described in claim 12, wherein said control surface element is shaped such that the every side of said bore remains in contact with said control surface element at all angles of said swash plate relative to a position perpendicular to said drive shaft.

23. A method of powering and controlling a swash plate in a variable swash plate compressor comprising the steps of:

rotating a drive shaft;

transferring the rotational drive of said drive shaft to a swash plate through the use of a control surface element sitting in a form fitted bore located in said swash plate and a pinnacle element sitting in a pocket formed in said swash plate, wherein said control surface element is affixed to said drive shaft and said pinnacle element is affixed to said control surface element; and varying the angle of said swash plate through the use of a fulcrum piston assembly, wherein said swash plate pivots about the tip of said pinnacle element;

wherein said tip of said pinnacle element passes over the axial center of at least one compression piston as said pinnacle element rotates about the axial center of said drive shaft.

24. A method as described in claim 23, wherein said pocket is formed along the center plane of said swash plate.

25. A method as described in claim 23, wherein said drive shaft, said control surface element and said pinnacle element are formed as a single element.

26. A method as described in claim 23, wherein said control surface element and said pinnacle element are formed as a single element.

27. A method as described in claim 24, wherein said control surface element is shaped such that the every side of said control surface element remains in contact with the swash plate at all angles of said swash plate relative to a position perpendicular to said drive shaft.

28. A method of powering and controlling a swash plate in a variable swash plate compressor comprising the steps of:

rotating a drive shaft;

transferring the rotational drive of said drive shaft to a swash plate through the use of a control surface element sitting in a form fitted bore located in said swash plate and a pinnacle element sitting in a pocket formed in said swash plate, wherein said control surface element is affixed to said drive shaft and said pinnacle element is affixed to said control surface element; and controlling the pressure of fluid in a fluid pressure chamber through the use of a control valve;

varying the position of a fulcrum piston assembly through by exposing said fulcrum piston assembly to the pressurized fluid in said fluid pressure chamber;

varying the angle of said swash plate through the use of a fulcrum piston assembly, wherein said swash plate pivots about the tip of said pinnacle element;

wherein said tip of said pinnacle element passes over the axial center of at least one compression piston as said pinnacle element rotates about the axial center of said drive shaft.

29. A method as described in claim 28, wherein said fulcrum piston assembly comprises:

a control piston in connection with fluid in said fluid pressure chamber;

a fulcrum element rotatably attached to said control piston, wherein said fulcrum element rotates with said drive shaft;

wherein as pressure is increased in said pressure chamber, said fulcrum piston assembly is moved towards said swash plate thereby increasing the angle of said swash plate relative to said drive shaft.

* * * * *